US009532618B2

(12) United States Patent
Garabedian

(10) Patent No.: US 9,532,618 B2
(45) Date of Patent: Jan. 3, 2017

(54) POCKET, AND MEANS FOR MANUFACTURING SAME

(71) Applicant: New Balance Athletic Shoe, Inc., Boston, MA (US)

(72) Inventor: Jeffrey Scott Garabedian, Boston, MA (US)

(73) Assignee: New Balance Athletics, Inc., Boston, MA (US)

( * ) Notice: Subject to any disclaimer, the term of this patent is extended or adjusted under 35 U.S.C. 154(b) by 342 days.

(21) Appl. No.: 13/835,512

(22) Filed: Mar. 15, 2013

(65) Prior Publication Data

US 2014/0259297 A1 Sep. 18, 2014

(51) Int. Cl.
*A41D 27/00* (2006.01)
*A41D 27/20* (2006.01)

(52) U.S. Cl.
CPC ..... *A41D 27/20* (2013.01); *A41D 27/205* (2013.01); *A41D 27/207* (2013.01)

(58) Field of Classification Search
CPC ..... A41D 27/20; A41D 27/205; A41D 27/207
USPC ..... 2/247–254, 227
See application file for complete search history.

(56) References Cited

U.S. PATENT DOCUMENTS

| | | | | |
|---|---|---|---|---|
| 56,821 | A | 7/1866 | Stecher | |
| 320,882 | A | 6/1885 | McCrystal et al. | |
| 530,542 | A | 10/1894 | Mahon | |
| 562,361 | A | 6/1896 | Johnson | |
| 738,168 | A | 9/1903 | Delavoye | |
| 874,815 | A | 12/1907 | Williams | |
| 1,027,904 | A | 5/1912 | Rogers | |
| 1,073,479 | A | 9/1913 | Dunbar et al. | |
| 1,075,240 | A | 10/1913 | Barrett | |
| 1,116,643 | A * | 11/1914 | Strobel | A41D 27/20 2/254 |
| 1,128,941 | A | 2/1915 | Brown | |
| 1,161,435 | A | 11/1915 | Baker | |
| 1,255,497 | A | 2/1918 | Ankele | |
| 1,257,048 | A | 2/1918 | Tamas | |
| 1,522,664 | A | 1/1925 | Wood | |
| 1,609,190 | A | 11/1926 | Place | |
| 1,664,460 | A | 4/1928 | Mayer | |
| 1,692,200 | A | 11/1928 | Capuano | |
| 1,743,045 | A | 1/1930 | Musselman | |

(Continued)

FOREIGN PATENT DOCUMENTS

DE 202011050261 U1 8/2012

OTHER PUBLICATIONS

International Preliminary Report for International Application No. PCT/US2013/027106 mailed Sep. 4, 2014, 8 pages.

*Primary Examiner* — Khaled Annis
(74) *Attorney, Agent, or Firm* — Goodwin Procter LLP

(57) ABSTRACT

The invention relates to pockets for a garment, and methods for manufacturing same. An example pocket includes an opening with a pocket bag extending from the opening within an inner portion of the garment, the pocket bag including an inner material portion and an outer material portion with connecting means fixedly connecting a first region of the inner material portion and a first region of the outer material portion to divide the pocket bag into a first compartment and a second compartment, the connecting means extending substantially upwards from a bottom portion of the pocket bag.

24 Claims, 9 Drawing Sheets

(56) References Cited

U.S. PATENT DOCUMENTS

| | | | | |
|---|---|---|---|---|
| 2,011,010 | A | 8/1935 | Peters | |
| 2,323,390 | A | 7/1943 | Friedman | |
| 2,558,382 | A * | 6/1951 | Previdi | 224/223 |
| 2,899,684 | A | 8/1959 | Riley | |
| 3,245,089 | A | 4/1966 | Blake | |
| 4,791,681 | A | 12/1988 | Dean | |
| 5,555,566 | A | 9/1996 | Kuhn | |
| 5,638,549 | A | 6/1997 | Thomas | |
| 6,148,443 | A | 11/2000 | Maastricht | |
| 6,374,421 | B1 * | 4/2002 | Cleary | 2/254 |
| 7,364,491 | B2 | 4/2008 | Updyke | |
| 2004/0016041 | A1 | 1/2004 | Uno et al. | |
| 2005/0246823 | A1 | 11/2005 | Groom | |
| 2007/0245444 | A1 | 10/2007 | Brink | |
| 2008/0148467 | A1 | 6/2008 | Sugiura | |
| 2008/0184459 | A1 | 8/2008 | Barnes | |
| 2008/0263742 | A1 | 10/2008 | Vaughn | |
| 2008/0295216 | A1 | 12/2008 | Nordstrom et al. | |
| 2009/0265828 | A1 | 10/2009 | Semba et al. | |
| 2009/0320183 | A1 | 12/2009 | Riney | |
| 2010/0281595 | A1 | 11/2010 | Gernes | |
| 2012/0093442 | A1 | 4/2012 | Lett | |

* cited by examiner

Section A --A

POCKET, AND MEANS FOR MANUFACTURING SAME

FIELD OF THE INVENTION

The present invention relates generally to the field of athletic equipment, and more particularly to a pocket for a garment, and garments incorporating same.

BACKGROUND OF THE INVENTION

During training (e.g., during a run), athletes often carry objects with them that are often held in pockets of the garments of the wearer. Example objects include, but are not limited to, wallets, money, keys, credit cards, credit card holders, snacks, phones, pagers, portable music players and other portable electronic devices, training aids (e.g., GPS enabled performance and/or location monitors), and the like. However, objects located within pockets such as the hip pockets of a garment for the lower portion of the body (e.g., shorts or sweat pants) can, during the athletic activity, move around significantly due to the motion of the athlete and potentially affect the performance of the athlete and/or damage the object being held within the pocket. In addition, objects such as portable electronic devices being utilized for entertainment during a training session (e.g., portable music players connected to headphones being worn by the athlete) can be bumped and jogged to a sufficient extent that they fail to function correctly (e.g., by skipping or otherwise distorting the music being played) and/or dislodge the connector between headphone and device. Such disruptions and irritations can significantly diminish the enjoyment of an athletic activity.

Traditional garment pockets either fail to address such considerations or require complex structures with significant additional material and manufacturing effort to attempt to address this issue.

SUMMARY OF THE INVENTION

As such, there is a need for an improved pocket configuration for a garment and, for example, for an athletic garment for a lower portion of a wearer's body, that provides improved stability and fit for an object held within the pocket without the need for additional material and significant manufacturing/labor effort that could increase the cost and complexity of the pocket. The present invention is therefore directed towards an improved pocket for a garment, and garments incorporating same.

One aspect of the invention includes a pocket for a garment, the pocket including an opening with a pocket bag extending from the opening within an inner portion of the garment, the pocket bag including an inner material portion and an outer material portion. The pocket bag includes a connecting element fixedly connecting a first region of the inner material portion and a first region of the outer material portion to divide the pocket bag into a first compartment and a second compartment, the connecting element extending substantially upwards from a bottom portion of the pocket bag. The pocket bag further includes at least one first securing element located proximate an entrance (e.g., an open top portion) to the second compartment to releasably secure an article or object therein. In one embodiment the second compartment is sized and configured to hold at least one portable electronic device (e.g., a multimedia device such as a cell phone).

In one embodiment the connecting element extends less than a full height of the pocket bag, such that the entrance to the second compartment is located below, and accessible from, the pocket opening. The connecting element may include, or consist essentially of, one or more stitch lines (e.g., a single or double stitch line).

The first securing element may include, or consist essentially of, at least one first elastic element, and the first elastic element may include, or consist essentially of, at least one first band (e.g., a self-biasing taping element) extending a width of the second compartment proximate the entrance. The at least one first band may be connected to or embedded within at least one of the inner material portion and an outer material portion and, for example, may be connected to at least one of the inner material portion and an outer material portion proximate first and second edges of the entrance. In one embodiment the elastic element may include, or consist essentially of, at least one first loop, wherein the at least one first loop can extend from at least one edge of the second compartment proximate the entrance. The pocket may further include at least one second securing element located below an entrance to the second compartment to assist in releasably securing an article therein. The second securing element can include at least one second elastic element, with the second elastic element, for example, including at least one second band extending a width of the second compartment below the entrance. The at least one second band may be connected to or embedded within at least one of the inner material portion and an outer material portion.

The connecting element can extend from a bottom edge/seam of the pocket bag or extend from a location within a bottom portion of the pocket bag but above the bottom edge/seam of the pocket bag. In one embodiment the connecting element can extend at an acute angle from the bottom portion of the pocket bag such that the second compartment has a width that varies from a bottom of the second compartment to the entrance to the second compartment. In an alternative embodiment the connecting element can extend vertically, or substantially vertically, upwards from the bottom portion of the pocket bag.

In one embodiment a bottom edge of the pocket bag extends a first distance from a top edge of the pocket bag within the first compartment, and extends a second distance from a top edge of the pocket bag within the second compartment. More particularly, in one embodiment the first distance is greater than the second distance.

Another aspect of the invention includes a garment for at least a portion of a lower portion of a wearer, the garment having at least one pocket, with the pocket including an opening and a pocket bag extending from the opening within an inner portion of the garment.

Another aspect of the invention includes a method for providing one or more elements for releasably securing an article within a garment. The method includes the step of providing a garment having at least one pocket, the pocket including an opening with a pocket bag extending from the opening within an inner portion of the garment, the pocket bag including an inner material portion and an outer material portion. The method further includes fixedly connecting a first region of the inner material portion and a first region of the outer material portion to divide the pocket bag into a first compartment and a second compartment, the connecting element extending substantially upwards from a bottom portion of the pocket bag, and locating at least one first securing element proximate an entrance to the second compartment to releasably secure an article therein.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

The invention described herein relates generally to a pocket for an article of apparel (or garment) and, for example, for an article of apparel for a lower portion of a body of a wearer (e.g., pants, capri pants, shorts, or leggings). In one embodiment the invention relates to a pocket for an article of apparel for wearing during athletic activity such as, but not limited to, running, jogging, cycling, and/or any other aerobic sporting activity.

Any appropriate natural and/or synthetic fiber, or fibers, may be used to form the various elements of the pocket, and the garment into which it is incorporated. Example materials may include woven or knit materials such as, but not limited to, cotton, wool, linen, silk, polyester, polyurethane, rayon, nylon, crimplene, acrylic, or the like. One embodiment may include materials incorporating one or more elastic material such as, but not limited to, latex or elastane (i.e., spandex).

Figure 1A:
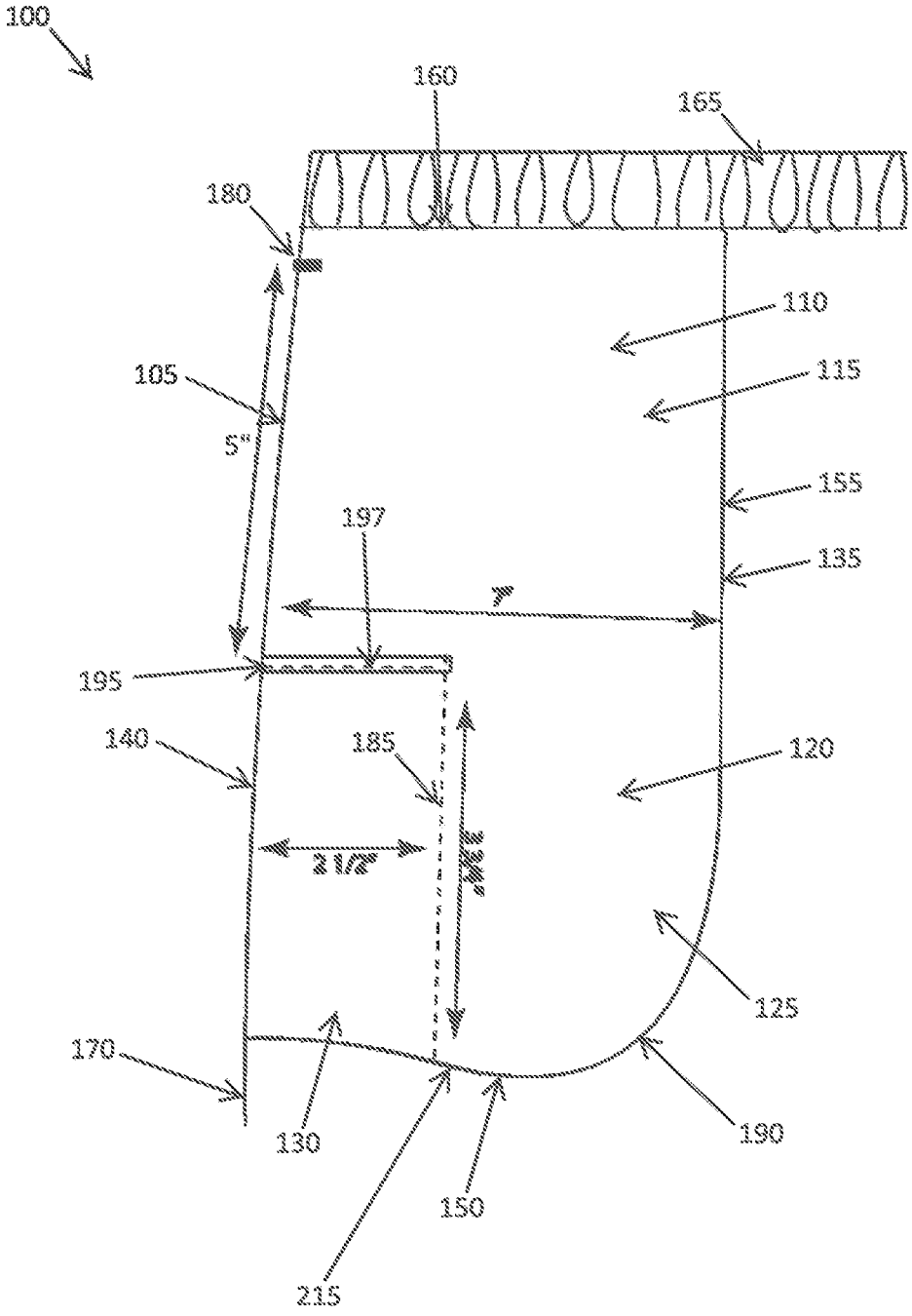
FIG. 1A is a schematic side view of a multi-compartment pocket for an article of apparel, in accordance with one embodiment of the invention.
Figure 1B:
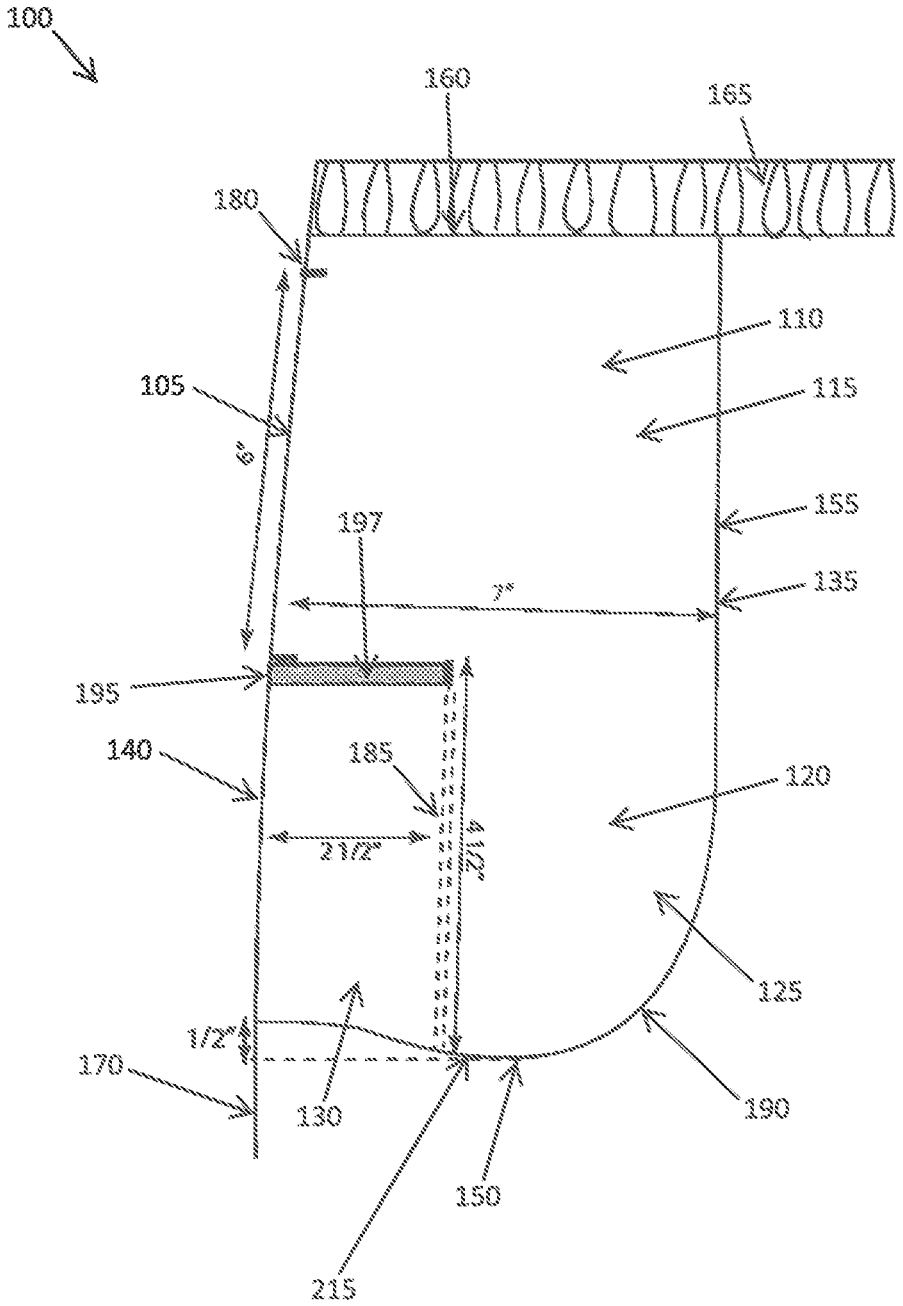
FIG. 1B is a schematic side view of another multi-compartment pocket for an article of apparel, in accordance with one embodiment of the invention.

An example pocket 100 for a garment (e.g., athletic pants or shorts) having multiple compartments within the pocket 100 is shown in FIGS. 1A and 1B. The pocket 100 includes an opening 105 and a pocket bag 110. The pocket bag includes an upper portion 115 proximate the opening and a lower portion 120 including a first compartment 125 positioned at a bottom of the pocket bag 110 away from the opening 105 and a second compartment 130 positioned in the lower portion 120 proximate the opening 105.

Figure 2A:
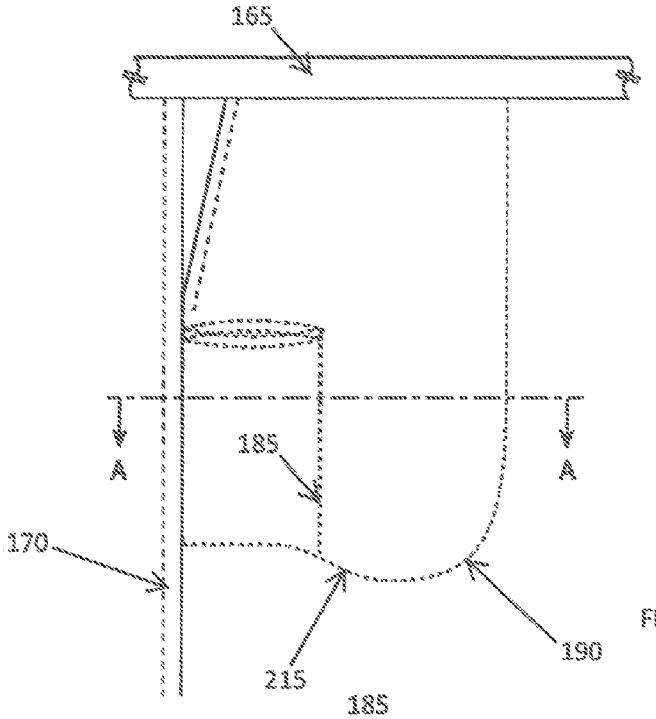
FIG. 2A is a schematic side view of a portion of an article of apparel with a multi-compartment pocket extending therein, in accordance with one embodiment of the invention.
Figure 2B:
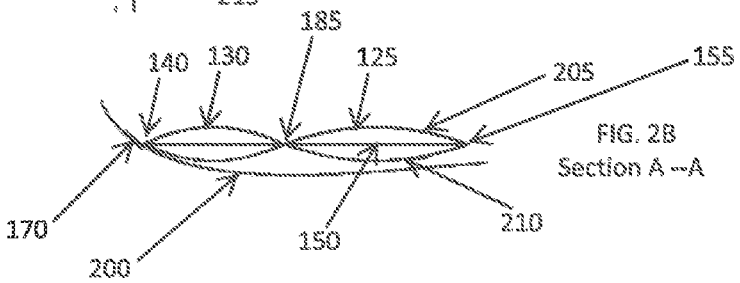
FIG. 2B is a plan view of the pocket of FIG. 2A through section A-A.

The pocket bag 110 is formed from an inner material portion 205 (which is positioned proximate the body) and an outer material portion 210 positioned proximate an outer surface of a garment 200 to which it is attached (see, for example, FIG. 2B). The inner material portion 205 and outer material portion 210 may be separate material elements attached (e.g., through sewing, fusing, and/or through an adhesive) at their perimeters to form a pocket bag 110 within the unattached central regions of the inner and outer material portions. Alternatively, the inner material portion 205 and outer material portion 210 may be two portions of a single piece of material folded over and attached at its perimeter 135 to form the pocket bag 110. The fold may be located along any appropriate edge of the perimeter 135 of the pocket bag 110. In one embodiment one of the inner material portion 205 or outer material portion 210 may be formed from a portion of the garment itself.

The perimeter 135 of the pocket bag 110 includes a first side edge 140 on the opening 105 side of the pocket 100 (and, for example, attached to, abutting, or proximate to, a side seam 170 of the garment), a bottom edge 150 at a bottom of the pocket bag 110, a second side edge 155 away from the opening 105 and a top edge 160 at a top of the pocket bag 110 and, for example attached to, abutting, or proximate to, a waistband 165 (e.g., an elastic, drawstring, and/or belted waistband) of the garment 200. The perimeter 135 may be formed with any appropriate shape and may, in one embodiment, be substantially rectangular or substantially square. The corners between adjoining edges may be sharp of have any appropriate size and shape of curvature. In the embodiment of FIGS. 1A, 1B, and 2A, for example, the bottom distal corner 190 (away from the opening 105 within the first compartment 125) has a curved configuration, while the bottom distal corner 190 of FIGS. 3 and 4A-4B, for example, have a sharp angled configuration.

In one embodiment the bottom edge 150 has a curved or stepped shape configured such that the bottom of the first compartment 125 is positioned further from the top edge 160 of the pocket bag 110 than the bottom of the second compartment 130, as shown, for example, in FIGS. 1A, 1B, and 2A (i.e., the bottom of the second compartment 130 may be a set height above the bottom of the first compartment 125). By configuring the bottom edge 150 in such a manner (i.e., with the bottom edge 150 arranged to provide a plurality of distances between the bottom edge 150 and the top edge 160 over the span of the pocket bag 110), the first compartment 125 can be adapted to hold larger and longer objects while the second compartment 130 can be positioned closer to the opening 105 to provide easier access for a user/wearer. In addition, positioning the second compartment 130 closer to the waistband 165 (which provides a stable anchoring position for the garment 200 when worn by an athlete) and, in some embodiments against a side seam 170 of the garment 200 (which provides a stronger, and potentially less flexible, element on the side of the garment 200), ensures that the second compartment will be held in a more stable position than the first compartment 125, with the position of the second compartment 130 reducing the vibration, shaking, and movement of an object held within the second compartment 130 in comparison to objects held in the first compartment 125 or held within a standard, traditional, pocket arrangement. For example, the position of the second compartment 130 can secure an object closer to the hip of the wearer, which naturally has less movement than lower areas of the leg during athletic activity due to the hip acting as a pivot point for the leg.

Figure 5:
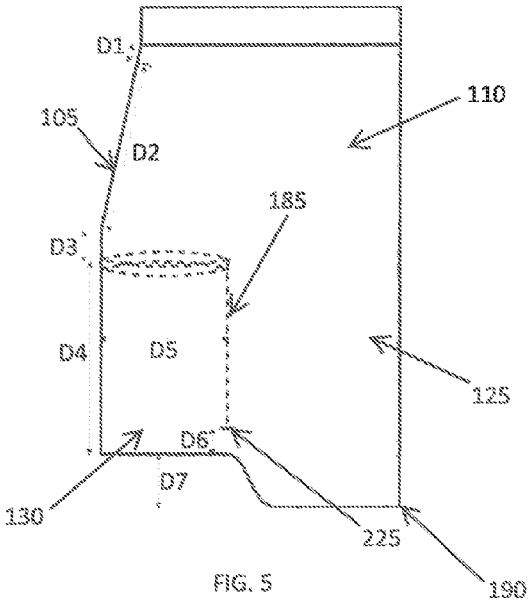
FIG. 5 is a schematic side view of another multi-compartment pocket with example dimensions marked thereon, in accordance with one embodiment of the invention.

The bottom of the second compartment 130 may be any appropriate height above the bottom of the first compartment 125, depending upon the specific requirements of the pocket bag 110 and, in certain embodiments, the height of the bottom of the second compartment 130 above the bottom of the first compartment 125 may range from zero up to 3 inches, or more (see distance D7 in FIG. 5). In the embodiment of FIG. 1B, for example, the height of the bottom of the second compartment 130 above the bottom of the first compartment 125 is 0.5 inches. In one embodiment the bottom of the second compartment 130 may be formed by one or more separate stitch lines (or other connecting element) located above the bottom edge 150 of the pocket bag. In further embodiments, stitch lines (or other connecting elements) may be positioned at any location within the pocket bag 110 to connect the inner material portion 205 and outer material portion 210 at discrete locations to divide the pocket bag 110 into any number and configuration of separate compartments.

Figure 3:
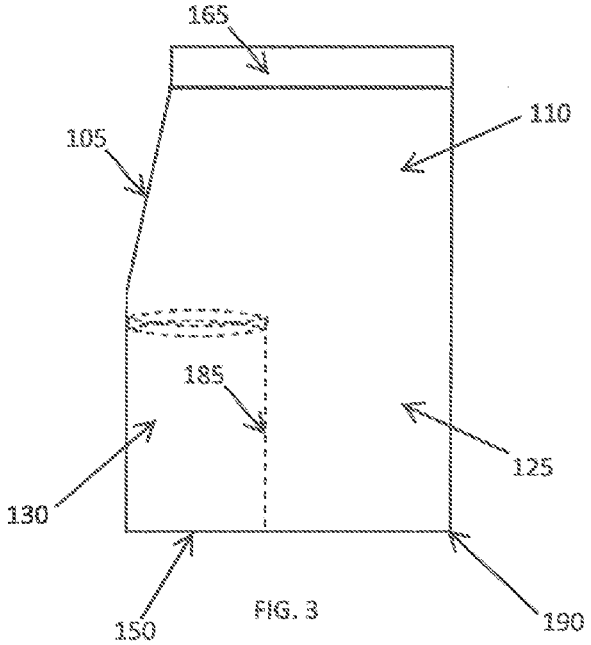
FIG. 3 is a schematic side view of another multi-compartment pocket, in accordance with one embodiment of the invention.
Figure 4A:
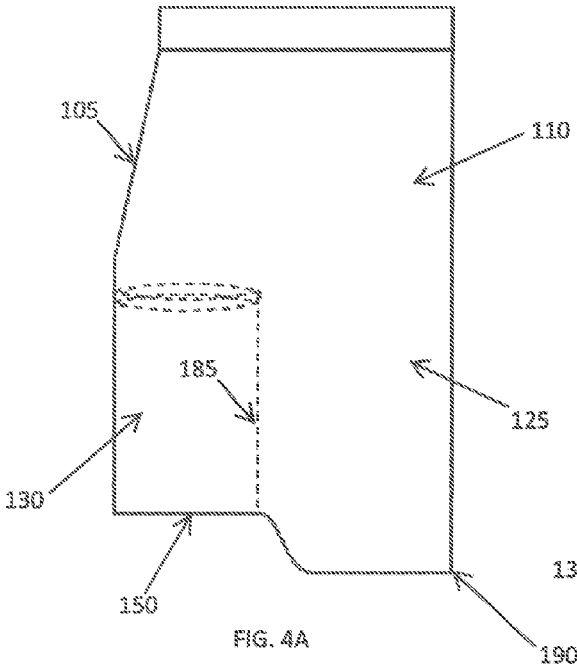
FIG. 4A is a schematic side view of another multi-compartment pocket, in accordance with one embodiment of the invention.

In one embodiment the bottom edge 150 can be configured with a first substantially constant height in the first compartment 125, a second substantially constant height in the second compartment 130, and with a curved intermediate section 215 therebetween (as shown, for example, in FIGS. 1A, 1B, and 2A). In an alternative embodiment the intermediate section 215 may include, or consist essentially of, any appropriately curved shape, linearly angled shape, and/or vertically, or substantially vertically, stepped shape. In various embodiments the bottom edge 150 may be substantially horizontally configured (i.e., substantially parallel to the longitudinal span of the waistband 165) within the first compartment 125 and/or second compartment 130 (or a majority thereof) or be curved and/or linearly angled at an acute angle with respect to the longitudinal span of the waistband 165. In an alternative embodiment, as shown in FIG. 3, the bottom edge 150 may be flat, or substantially flat, over the entire width, or a majority of the width, of the pocket bag 110, thereby forming a pocket bag 110 with a first compartment 125 and second compartment 130 having a bottom distanced the same distance from the top edge 160 of the pocket bag 110. In a further alternative embodiment the bottom edge 150 may be shaped and configured to produce a pocket bag 110 having the bottom of the second compartment 130 positioned further from the top edge 160 than the bottom of the first compartment 125. This may be advantageous, for example, in embodiments where the second compartment 130 is to be configured to hold a longer object than a pocket generally holds.

Figure 4B:
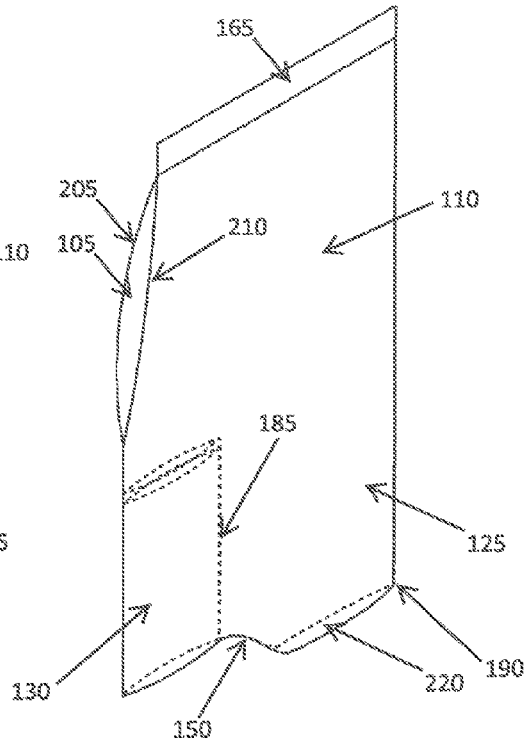
FIG. 4B is a perspective view of the multi-compartment pocket of FIG. 4A.

In one embodiment, as shown in FIG. 2B, the bottom edge 150 may be a single edge joining the inner material portion 205 and an outer material portion 210 along a bottom of the pocket bag 110. In an alternative embodiment, as shown in FIG. 4B, the bottom edge 150 may include an additional piece of material 220 extending between the inner material portion 205 and an outer material portion 210.

The first compartment 125 and second compartment 130 can be separated by one or more connecting elements 185 connecting the inner material portion 205 and outer material portion 210 to produce a barrier separating the two compartments. In one embodiment the connecting element 185 includes, or consists essentially of, one or more stitch lines (e.g., a single or double stitch line and, for example, a ⅛ inch DN stitch) stitching the inner material portion 205 and an outer material portion 210 together. In an alternative embodiment the connector may include or consist essentially of, a bonding element (e.g., a fabric adhesive), a plurality of discrete fixing elements (e.g., a plurality of buttons or studs) or a releasable connecting element such as, but not limited to, a hook-and-loop fixing mechanism, a zipper, or the like. Utilizing a simple connecting element 185, such as a stich line or bonding line, allows for the formation of a compartmentalized pocket without the need for additional material to be utilized within the pocket to produce the second compartment, as is generally required in traditional pocket configurations. This can significantly reduce material costs, labor costs, and time during manufacturing, while providing a simple and effective solution that doesn't add any noticeable weight, bulk, or complexity to the structure of the pocket. In an alternative embodiment the connecting element 185 can include an additional piece of material extending between the inner material portion 205 and an outer material portion 210 and being stitched, bonded, or otherwise attached at its edges thereto. This may be of use, for example, in embodiments where relatively thick and/or complexly shaped objects are to be held within the pocket 100.

In one embodiment the connecting element 185 can extend all the way to the bottom edge 150 of the pocket bag 110 as shown, for example, in FIGS. 1A, 1B, and 2A. In another embodiment, as shown in FIG. 5, the connecting element 185 can extend down towards the bottom region of the second compartment 130, but does not extend all the way to the bottom edge 150 of the pocket bag 110. Rather, the bottom 225 of the connecting element 185 can be located a distance D6 above the bottom edge 150 of the pocket bag 110. This may be advantageous, for example, in providing a space for smaller objects (e.g., coins) to fall from the second compartment 130 to the first compartment 125 while larger objects (e.g., portable electronic devices, are held securely within the second compartment 130. The gap D6 can also allow for a connector wire (e.g., for headphones or a power supply) to be threaded through the gap D6 to attach to a bottom portion of a portable electronic device being held within the second compartment 130.

In one embodiment one or more securing elements 195 can be located within, adjacent to, or proximate the second compartment 130. As shown, for example, in FIGS. 1A and 1B, the securing element 195 may be an element, and for example an elastic element (a band) and/or a self-biasing element, extending across a top (or entrance) 197 of the second compartment 130 to provide means for stably and releasably holding an object in the second compartment 130. The securing element 195 may be of any appropriate size and shape and may, for example, include, or consist essentially of, self-bias tape having a width of about 0.25 inches. The tape may be attached to the inner material portion 205 and/or outer material portion 210 in any appropriate manner (e.g., through stitching or adhesion) and may, for example, be finished at its ends by a bendback.

In alternative embodiments wider or narrower securing elements 195 may be utilized, as appropriate. The securing element 195 may be embedded within or attached to the inner material portion 205 and outer material portion 210 along its full length, or be attached to the inner material portion 205 and/or outer material portion 210 at only discrete locations (e.g., at the sides of the second compartment 130). The securing element 195 may be stitched, bonded, or otherwise attached to the inner material portion 205 and/or outer material portion 210.

In one embodiment, as shown in FIGS. 1A and 1B, the entrance, or top opening 197, of the second compartment 130 can be located adjacent to the bottom of the opening 105. This may be advantageous, in certain embodiments, in insuring the easiest possible access to the second compartment 130. In an alternative embodiment, as shown, for example, in FIG. 5, the top 197 of the second compartment 130 can be located a distance D3 below the bottom of the opening 105. The distance D3 may be of any appropriate distance and can, in certain embodiments, range from about zero to about 2 inches. Locating the top 197 of the second compartment 130 below the bottom of the opening 105 may be advantageous, in certain embodiments, in allowing a hand of a wearer to more easily pass around the top 197 of the second compartment 130 to gain access to the first compartment 125.

In the embodiment of FIGS. 1A and 1B the opening 105 is five (5) inches and six (6) inches respectively in length and extends at a shallow acute angle to the first side edge 140. In an alternative embodiment the opening 105 may be of any appropriate length (see distance D2 in FIG. 5) and may, for example, range from between 4 to 7 inches, and the opening may extend at any appropriate angle from the first side edge 140 (for example between 0° and 90°). In one embodiment a bartack stitch 180 is positioned at the top of the opening 105 to securely define the top of the opening 105. The bartack 180 may be positioned at any appropriate distance from the bottom of the waistband 165 (see distance D1 in FIG. 5) and may, for example, be placed between 0 and 1 inch from the waistband 165 and, in one embodiment, be placed 0.5 inches from the waistband. In an alternative embodiment no bartack is required. In a further alternative embodiment a plurality of bartacks may be incorporated into the pocket 100 at a number of discrete locations to provide additional support for the pocket 100 in regions of higher stress. For example, the embodiment of FIG. 1B shows bartacks 180 at the bottom of the pocket opening 105 and at the upper end of the connecting element 185.

The second compartment 130 as shown in FIGS. 1A and 1B has a width of 2.5 inches and a height of 3.75 inches (for FIG. 1A) and 4.4 inches (for FIG. 1B). In an alternative embodiment the width and height may be of any appropriate value necessary to hold an object or range of objects (such as a portable electronic device, credit card or credit card holder, wallet, etc.)—see distances D4 (height) and D5 (width) in FIG. 5. For example, the width of the second compartment 130 may be as narrow as 0.5 to 1 inch (if a pen or other slender object is to be held, or may be as broad as 3 to 5 inches (if a larger element such as a passport holder or wallet is to be held). Generally, however, when the second compartment 130 is adapted to hold a personal electronic device, the width of the second compartment 130 will range from 2 to 3.5 inches in diameter, depending upon the sizes of the device, or range of devices, to be held, the degree of stability required of the device within the second compartment 130, and the functionality of any securing mechanisms utilized in the pocket 100.

The overall geometry of the pocket 100 may be configured with any appropriate length and depth. As shown in FIGS. 1A and 1B, the width of the pocket bag 110 may be seven (7) inches, although in an alternative embodiment any appropriate pocket width may be utilized such as, but not limited to, pockets having a width of between 4 to 8 inches. The pocket bag 110 may also have any appropriate overall height and, for example, may have an overall height ranging from between 6 to 12 inches.

Figure 6:
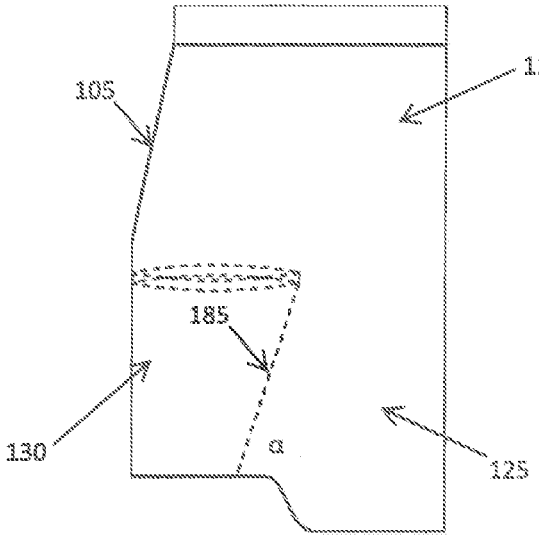
FIG. 6 is a schematic side view of another multi-compartment pocket, in accordance with one embodiment of the invention.

In one embodiment, as shown, for example, in FIGS. 1A and 1B, the connecting element 185 can be oriented substantially vertically within the pocket bag 110 (e.g., oriented substantially perpendicular to the bottom edge 150 of the pocket bag 110 and/or the longitudinal span of the waistband 165, as appropriate). In an alternative embodiment, as shown in FIG. 6, the connecting element 185 may be oriented at an angle to the vertical (or an angle "α" to the horizontal). The connecting element 185 may be substantially straight and angled at a single angle or be curved in any appropriate manner. This may be advantageous, in certain embodiments, in allowing objects of varying size, and/or objects having more complex geometries, to be securely held within the second compartment 130. In various embodiments any appropriate angle and, for example, an angle of between 0° and 45°, may be utilized (i.e., an angle "α" of between 45° and 90°).

Figure 7:
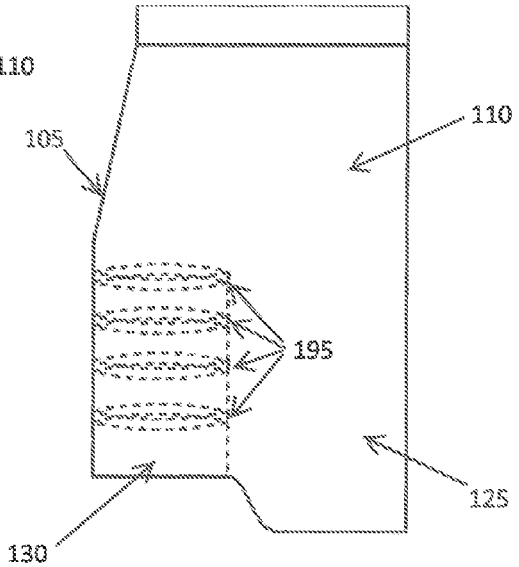
FIG. 7 is a schematic side view of another multi-compartment pocket, in accordance with one embodiment of the invention.

In one embodiment, as shown, for example, in FIG. 7, the second compartment 130 may include a plurality of securing elements 195 arranged at regular (or, in an alternative embodiment, irregular) intervals throughout the height of the second compartment 130. Any number, orientation, and/or configuration of securing elements 195 may be utilized, as appropriate for the specific object, or objects being held therein. Utilizing a plurality of securing elements 195 may be beneficial, for example, in allowing various objects of various heights to be secured within the second compartment 130, with the lower securing elements 195 holding the object in place along its sides, and the securing element(s) 195 above object biasing the inner material portion 205 and outer material portion 210 together above the object to prevent it exiting out of the top 197 of the second compartment 130.

Figure 8:
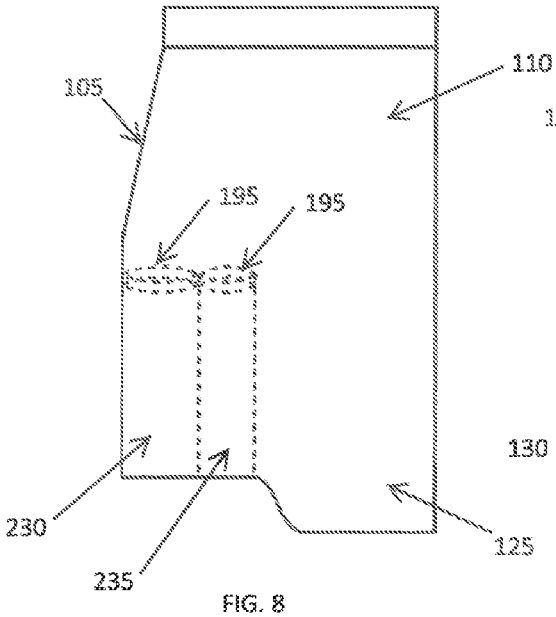
FIG. 8 is a schematic side view of another multi-compartment pocket, in accordance with one embodiment of the invention.

One embodiment of the invention may include a plurality of first compartments and/or a plurality of second compartments. An embodiment including two second compartments of differing width (230, 235) is shown in FIG. 8, with each compartment (230, 235) having a separate securing element 195 located at a top thereof. In an alternative embodiment any appropriate number, shape, and size of first compartments and/or second compartments may be formed within a pocket.

Figure 9:
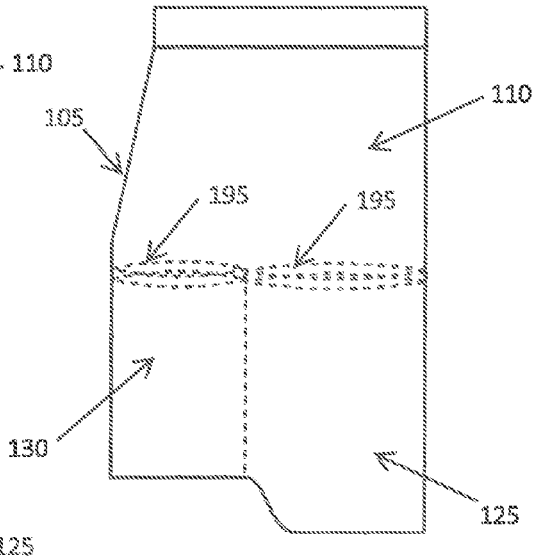
FIG. 9 is a schematic side view of another multi-compartment pocket, in accordance with one embodiment of the invention.

One embodiment of the invention may have the same, similar, or different securing elements 195 within and/or above both the second compartment 130 and the first compartment 125. An example embodiment having a separate securing element extending along the top of both the first compartment 125 and second compartment 130 is shown in FIG. 9. In an alternative embodiment securing elements may only be located within and/or above the first compartment 125.

Figure 10:
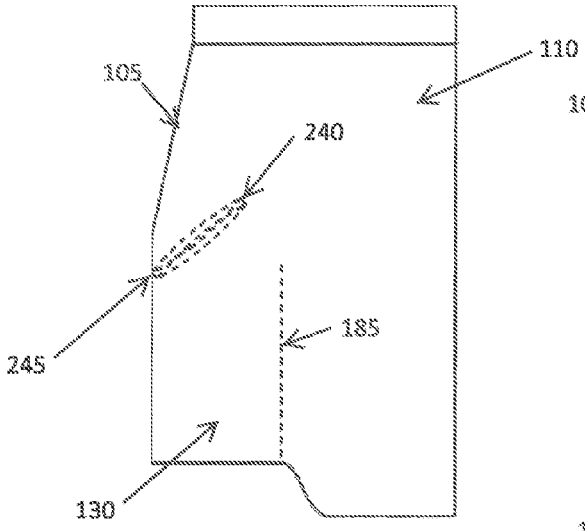
FIG. 10 is a schematic side view of another multi-compartment pocket, in accordance with one embodiment of the invention.
Figure 11:
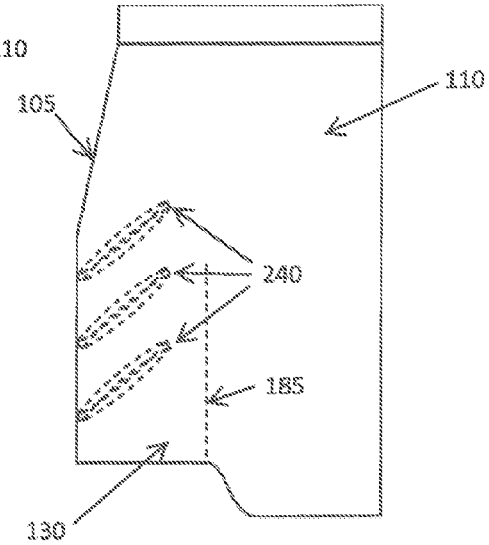
FIG. 11 is a schematic side view of another multi-compartment pocket, in accordance with one embodiment of the invention.

In one embodiment the securing element(s) 195 may include, or consist essentially of, a loop of material extending from a single anchoring location within and/or above the second compartment 130. For example, as shown in FIG. 10, a loop 240 is anchored to an upper corner 245 of the second compartment 130 proximate the opening 105 of the pocket 100. The loop 240 may be formed from any appropriate material and, in one embodiment may include, or consist essentially of, an elastic material. In operation, an object to be held within the second compartment 130 may be pushed through the loop 240 and held in place by the resistance of the loop 240 to movement by the object. The loop 240 also has an added benefit in that it can be used as a fastening element for keys or other objects with clipping-type elements to hold them securely within the pocket. In one embodiment, as shown in FIG. 11, a plurality of loops 240 may be positioned within and/or above the second compartment 130. In an alternative embodiment a securing element 195 including a band of elastic and/or self-biasing material spans the second compartment 130 and is stitched or otherwise connected to the sides of the second compartment 130 with the central portion, or a part thereof, unattached to either the inner material portion 205 and/or outer material portion 210. This free band portion may act as a fastening element as described above.

Figure 12:
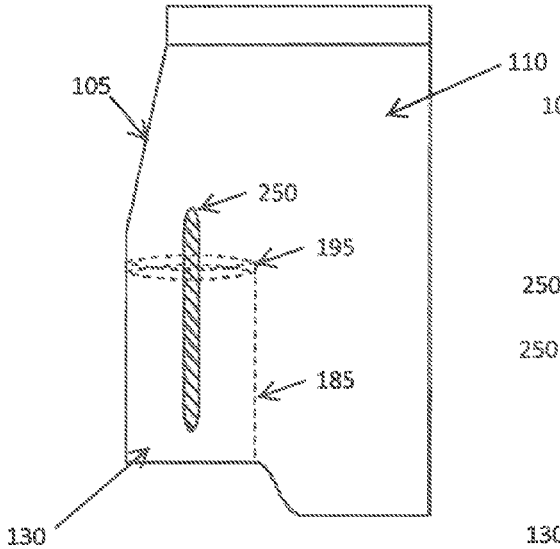
FIG. 12 is a schematic side view of another multi-compartment pocket, in accordance with one embodiment of the invention.
Figure 13:
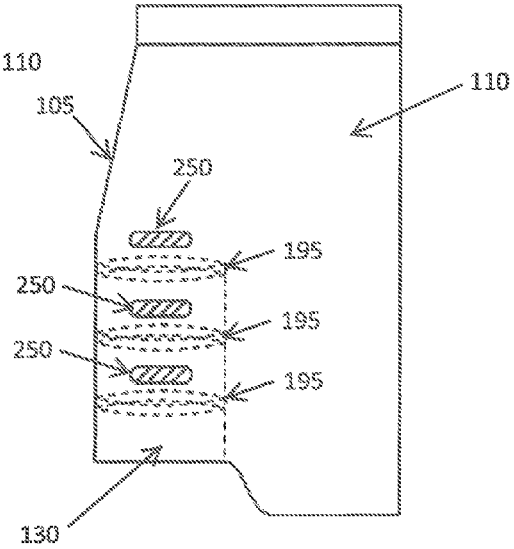
FIG. 13 is a schematic side view of another multi-compartment pocket, in accordance with one embodiment of the invention.
Figure 14:
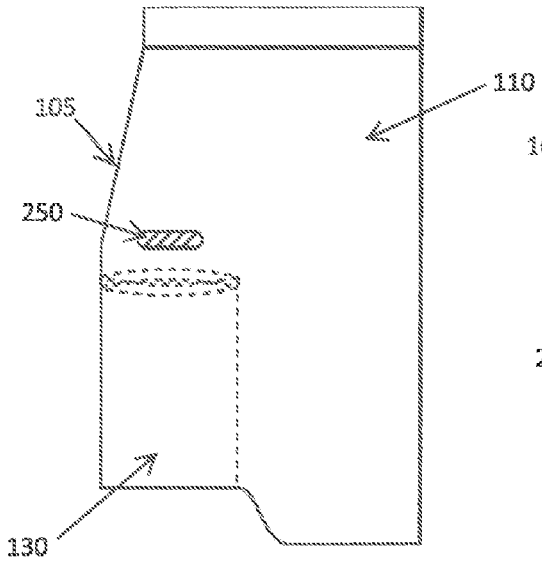
FIG. 14 is a schematic side view of another multi-compartment pocket, in accordance with one embodiment of the invention.
Figure 15:
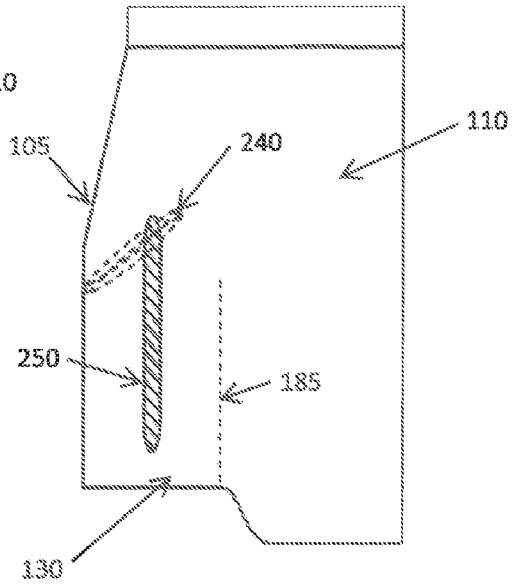
FIG. 15 is a schematic side view of another multi-compartment pocket, in accordance with one embodiment of the invention.
Figure 16:
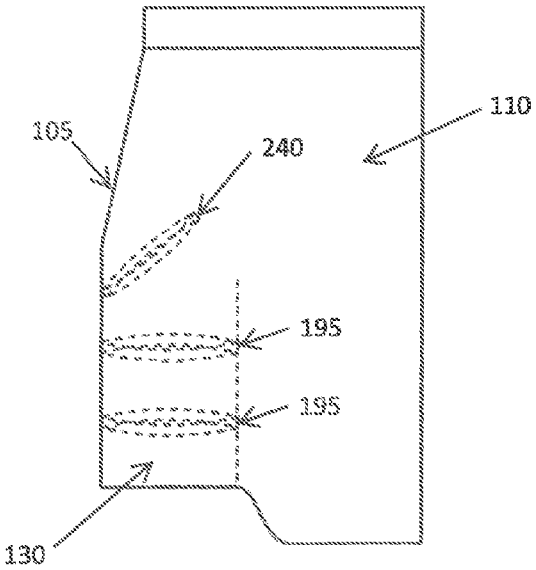
FIG. 16 is a schematic side view of another multi-compartment pocket, in accordance with one embodiment of the invention.

In one embodiment the securing element(s) 195 can include discrete elements attached to one or both of the inner material portion 205 and outer material portion 210 to assist in securing an object, or objects, within the second compartment 130. An example pocket including a discrete securing device 250 located within the second compartment 130 is shown in FIG. 12. The discrete securing device 250 may include, or consist essentially of, devices and elements such as, but not limited to, hook-and-loop closures (with the hook element attached to one of the inner material portion 205 and outer material portion 210 and the loop element attached opposite the hook element on the other material portion), tacky material portions on one or both of the inner material portion 205 and outer material portion 210 (e.g., tacky adhesive elements bonded to, or embedded in, the material portion), buttons, studs, snaps, and the like.

The discrete securing device 250 of FIG. 12 is an elongate element extending down a majority of the second compartment 130. As a result, the discrete securing device 250 can be adjusted to secure an object of a variety of heights with the second compartment 130. In alternative embodiments the discrete securing device 250 may be of any appropriate size, shape, and configuration, and may be located at any appropriate position within and/or above the second compartment 130 and, in some embodiments the first compartment 125. In one embodiment a plurality of discrete securing devices 250 may be utilized in addition to, or instead of, one or more band-like, loop-like, or other securing element(s) 195. Various combinations of single and multiple securing elements 195 (including bands, loops, and discrete securing devices 250, are shown in FIGS. 12 through 16).

Figure 17:
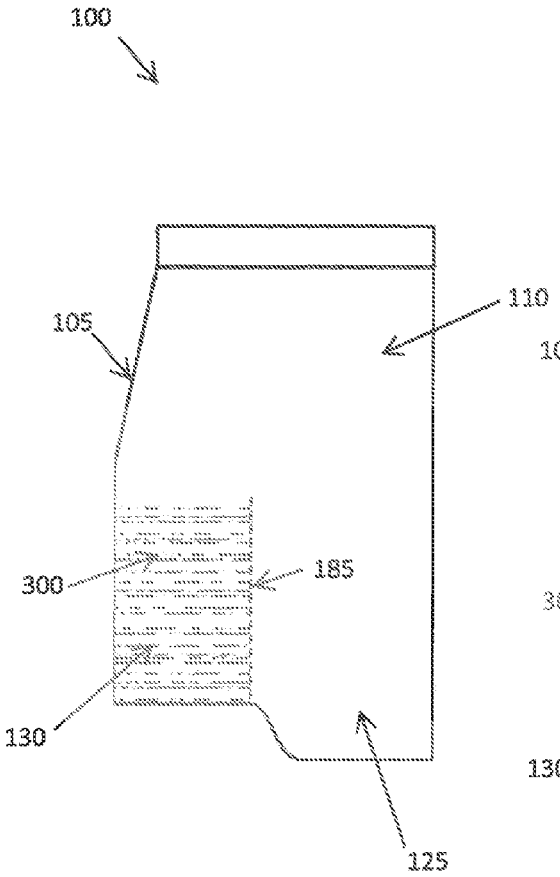
FIG. 17 is a schematic side view of another multi-compartment pocket, in accordance with one embodiment of the invention.
Figure 18:
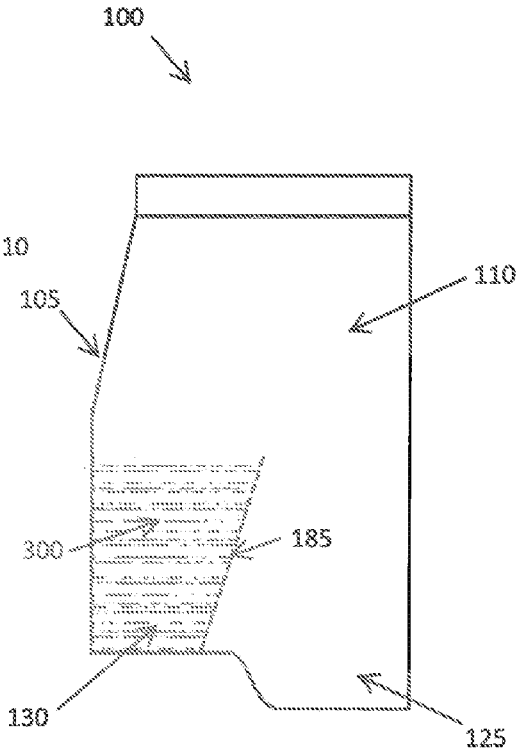
FIG. 18 is a schematic side view of another multi-compartment pocket, in accordance with one embodiment of the invention.

In one embodiment the inner material portion 205 and/or outer material portion 210 may include a compression material (e.g., an elastic material such as latex or spandex) which may form the inner material portion 205 and outer material portion 210, or a portion thereof, or be attached to a portion of the inner material portion 205 and outer material portion 210. This compression material can be used to grip the object held within the second compartment 130 and/or first compartment 125 to ensure a secure positioning of the object within the pocket bag 110. Example pockets 100 incorporating compression material portions 300 within the second compartment 130 are shown in FIGS. 17 and 18.

In one embodiment the inside of a portion of the pocket 100 and, for example, the inside of the second compartment 130, may have a tacky material or other appropriate gripping material coated or otherwise affixed thereto (or embedded within inner material 205 or outer material 210 within that region) to provide additional grip to securely hold an object in place within the pocket 100.

In one embodiment reinforcement/boning elements may be located at one or more region of the pocket 100 to provide additional stability and support for an object placed within the pocket 100. This reinforcement may take the form of a material (e.g., a stiff material such as a plastic) being sewn into or bonded to a portion of the pocket bag 110 and, for example, at a connecting element 185 and/or at a first side edge 140 proximate the second compartment 130.

Figure 19:
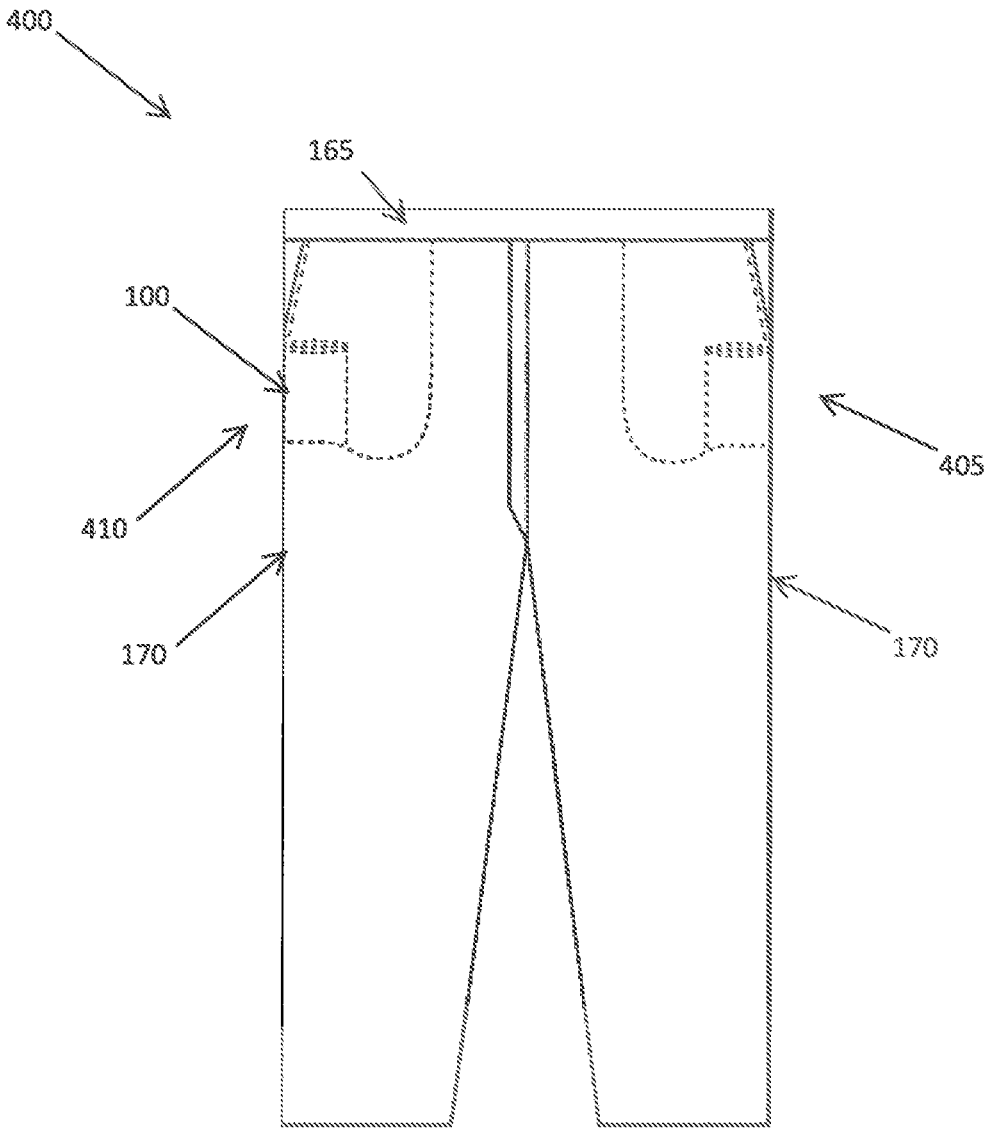
FIG. 19 is a schematic front view of a pair of pants incorporating a pair of multi-compartment pockets, in accordance with one embodiment of the invention.

As discussed above, the pocket, or pockets, may be incorporated into any appropriate article of apparel for the lower and/or upper portion of a body of a wearer. An example pair of pants 400 incorporating pockets 100 at the left 405 and right 410 hips is shown in FIG. 19. In various embodiment a multi-compartment pocket 100, or pockets, may be positioned at any appropriate location on the garment, depending upon the specific requirements of the garment and athlete.

It should be understood that alternative embodiments, and/or materials used in the construction of embodiments, or alternative embodiments, are applicable to all other embodiments described herein.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A pocket for a garment including a waistband adapted to encircle a waist of a wearer when worn and a side seam, the pocket comprising:

an opening; and a pocket bag positioned at a first side edge, the first side edge at least one of attached to, against, and abutting the side seam and extending from the opening within an inner portion of the garment, the pocket bag having a top edge proximate the waistband and comprising an inner material portion and an outer material portion, wherein the pocket bag further comprises:

(i) a connecting element fixedly connecting a first region of the inner material portion and a first region of the outer material portion to divide the pocket bag into a first compartment and a second compartment, the connecting element extending substantially upwards from a bottom edge of the pocket bag forming a bottom edge of the second compartment opposite from the waistband; and (ii) at least one first securing element comprising at least one first elastic element comprising at least one first band extending a width of the second compartment and located proximate an entrance to the second compartment to releasably secure an article therein, wherein the entrance is adjacent the pocket opening and above the bottom edge of the second compartment, such that the second compartment opens toward the top edge and the waistband.

2. The pocket of claim 1, wherein the connecting element extends less than a full height of the pocket bag, such that the entrance to the second compartment is located below, and accessible from, the pocket opening.

3. The pocket of claim 1, wherein the connecting element comprises at least one stitch line.

4. The pocket of claim 1, wherein the connecting element extends from a location within the bottom edge of the pocket bag to a location above the bottom edge of the pocket bag.

5. The pocket of claim 1, wherein the at least one first band is at least one of connected to and embedded within at least one of the inner material portion and the outer material portion.

6. The pocket of claim 1, wherein the at least one first band is connected to at least one of the inner material portion and the outer material portion proximate the first side edges of the entrance to the second compartment.

7. The pocket of claim 1, wherein the at least one first securing element comprises at least one first loop.

8. The pocket of claim 7, wherein the at least one first loop extends from at least one side edge of the second compartment proximate the entrance.

9. The pocket of claim 1, wherein the second compartment is sized and configured to hold at least one portable electronic device.

10. The pocket of claim 1, wherein the connecting element extends at an acute angle from the bottom edge of the pocket bag such that the second compartment has a width that varies from a bottom of the second compartment to the entrance to the second compartment.

11. The pocket of claim 1, further comprising at least one second securing element located proximate the entrance to the second compartment to assist in releasably securing the article therein.

12. The pocket of claim 11, wherein the at least one second securing element comprises at least one second elastic element.

13. The pocket of claim 12, wherein the at least one second elastic element comprises at least one second band extending a width of the second compartment below the entrance.

14. The pocket of claim 13, wherein the at least one second band is at least one of connected to and embedded within at least one of the inner material portion and the outer material portion.

15. The pocket of claim 1, wherein the bottom edge of the pocket bag extends a first distance from the top edge of the pocket bag within the first compartment, and extends a second distance from the top edge of the pocket bag within the second compartment.

16. The pocket of claim 15, wherein the first distance is greater than the second distance.

17. The pocket of claim 1, wherein the entrance extends from the first side edge at an angle between zero degrees and 90 degrees.

18. The pocket of claim 1, wherein the entrance is less than about two inches below the pocket opening.

19. The pocket of claim 1, wherein the second compartment comprises a side edge at least one of attached to, against, and abutting the side seam.

20. A garment including a waistband adapted to encircle a waist of a wearer when worn and a side seam for at least a portion of a lower portion of a wearer, the garment having at least one pocket with the pocket comprising:

an opening; and a pocket bag positioned at a first side edge, the first side edge at least one of attached to, against, and abutting the side seam and extending from the opening within an inner portion of the garment, the pocket bag having a top edge proximate the waistband and comprising an inner material portion and an outer material portion, wherein the pocket bag further comprises:

(i) a connecting element fixedly connecting a first region of the inner material portion and a first region of the outer material portion to divide the pocket bag into a first compartment and a second compartment, the connecting element extending substantially upwards from a bottom edge of the pocket bag forming a bottom edge of the second compartment opposite from the waistband; and (ii) at least one first securing element comprising at least one first elastic element comprising at least one first band extending a width of the second compartment and located proximate an entrance to the second compartment to releasably secure an article therein, wherein the entrance is adjacent the pocket opening and above the bottom edge of the second compartment, such that the second compartment opens toward the top edge and the waistband.

21. The garment of claim 20, wherein the entrance extends from the first side edge at an angle between zero degrees and 90 degrees.

22. The garment of claim 20, wherein the entrance is less than about two inches below the pocket opening.

23. The garment of claim 20, wherein the second compartment comprises a side edge at least one of attached to, against, and abutting the side seam.

24. A method for releasable securing an article within a garment, the method comprising the steps of:

providing a garment including a waistband adapted to encircle a waist of a wearer when worn and a side seam and having at least one pocket, the pocket comprising (i) an opening and (ii) a pocket bag positioned at a first side edge, the first side edge at least one of attached to, against, and abutting the side seam and extending from the opening within an inner portion of the garment, the pocket bag having a top edge proximate the waistband and comprising an inner material portion and an outer material portion;

fixedly connecting, by a connecting element, a first region of the inner material portion and a first region of the outer material portion to divide the pocket bag into a first compartment and a second compartment, the connecting element extending substantially upwards from a bottom edge of the pocket bag forming a bottom edge of the second compartment opposite from the waistband; and locating at least one first securing element comprising at least one first elastic element comprising at least one first band extending a width of the second compartment proximate an entrance to the second compartment, the entrance adjacent the pocket opening and above the bottom edge of the second compartment, such that the second compartment opens toward the top edge and the waistband to releasably secure an article therein.

* * * * *